US011739886B2

(12) United States Patent
Van Bommel et al.

(10) Patent No.: US 11,739,886 B2
(45) Date of Patent: Aug. 29, 2023

(54) LED FILAMENT ARRANGEMENT

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/762,395

(22) PCT Filed: Sep. 28, 2020

(86) PCT No.: PCT/EP2020/077154
§ 371 (c)(1),
(2) Date: Mar. 22, 2022

(87) PCT Pub. No.: WO2021/063902
PCT Pub. Date: Apr. 8, 2021

(65) Prior Publication Data

US 2022/0364684 A1 Nov. 17, 2022

(30) Foreign Application Priority Data

Oct. 1, 2019 (EP) ..... 19200862

(51) Int. Cl.

| | |
|---|---|
| ***F21K 9/232*** | (2016.01) |
| ***F21K 9/237*** | (2016.01) |
| ***F21V 3/08*** | (2018.01) |
| ***F21Y 115/10*** | (2016.01) |

(52) U.S. Cl.
CPC ..... *F21K 9/232* (2016.08); *F21K 9/237* (2016.08); *F21V 3/08* (2018.02); *F21Y 2115/10* (2016.08)

(58) Field of Classification Search
CPC ..... F21K 9/232; F21K 9/237; F21V 3/08
See application file for complete search history.

(56) References Cited

U.S. PATENT DOCUMENTS

| | | | |
|---|---|---|---|
| 2014/0362565 | A1 | 12/2014 | Yao et al. |
| 2017/0241598 | A1 | 8/2017 | Jiang |
| 2019/0017657 | A1 | 1/2019 | Kim et al. |

FOREIGN PATENT DOCUMENTS

| | | | |
|---|---|---|---|
| CN | 203850336 | U | 9/2014 |
| CN | 108826032 | A | 11/2018 |
| CN | 108916677 | A | 11/2018 |

(Continued)

*Primary Examiner* — Karabi Guharay

(57) ABSTRACT

A light emitting diode, LED, filament arrangement (100), comprising at least one LED filament (120) comprising an array of a plurality of light emitting diodes (125), LEDs, wherein the at least one LED filament comprises a first portion (130) having a first shape, wherein the first portion is configured to emit light of a first spectral distribution, $S_1$, in a first spatial direction, $D_1$, and a second portion (140) having a second shape, different from the first shape, and the second portion is configured to emit light of a second spectral distribution, $S_2$, in a second spatial direction, $D_2$, wherein the first spectral distribution, $S_1$, is different from the second spectral distribution, $S_2$, and the first spatial direction, $D_1$, is different from the second spatial direction, $D_2$.

14 Claims, 6 Drawing Sheets

(56) References Cited

FOREIGN PATENT DOCUMENTS

| | | | | | |
|---|---|---|---|---|---|
| CN | 208204578 | U | 12/2018 | | |
| WO | 2017162530 | A1 | 9/2017 | | |
| WO | 2018157428 | A1 | 9/2018 | | |
| WO | 2019015763 | A1 | 1/2019 | | |
| WO | 2019166273 | A1 | 9/2019 | | |
| WO | WO-2020151994 | A1 * | 7/2020 | ..... | F21K 9/232 |

* cited by examiner

LED FILAMENT ARRANGEMENT

CROSS-REFERENCE TO PRIOR APPLICATIONS

This application is the U.S. National Phase application under 35 U.S.C. § 371 of International Application No. PCT/EP2020/077154, filed on Sep. 28, 2020, which claims the benefit of European Patent Application No. 19200862.1, filed on Oct. 1, 2019. These applications are hereby incorporated by reference herein.

FIELD OF THE INVENTION

The present invention generally relates to lighting arrangements comprising one or more light emitting diodes, LEDs. More specifically, the lighting arrangement is related to a light emitting diode, LED, filament arrangement. The present invention is further related to a LED filament lamp comprising the LED filament arrangement.

BACKGROUND OF THE INVENTION

The use of light emitting diodes, LEDs, for illumination purposes continues to attract attention. Compared to incandescent lamps, fluorescent lamps, neon tube lamps, etc., LEDs provide numerous advantages such as a longer operational life, a reduced power consumption, and an increased efficiency related to the ratio between light energy and heat energy.

Many LED filament lamps or devices in the prior art comprise LED filaments which are able to produce warm white light. However, it is of interest to improve the properties of the light emitted from the LED filaments without impairing the appearance and/or the decorative aspect of the LED filaments and/or the LED filament lamps.

Hence, it is an object of the present invention to improve the properties of the light emitted from the LED filaments without impairing the appearance and/or the decorative aspect of the LED filaments and/or the LED filament lamps.

SUMMARY OF THE INVENTION

Hence, it is of interest to explore the possibility of combining one or more of the numerous advantages of LED filament arrangements comprising LEDs, whilst improving the properties of the light emitted from the LED filaments without impairing the appearance and/or the decorative aspect of the LED filaments and/or the LED filament lamps.

This and other objects are achieved by providing a LED filament arrangement having the features in the independent claim. Preferred embodiments are defined in the dependent claims.

Hence, according to the present invention, there is provided a LED filament arrangement comprising at least one LED filament. The LED filament(s) comprise(s) an array of a plurality of light emitting diodes, LEDs. The LED filament(s) further comprise(s) a first portion having a first shape, wherein the first portion is configured to emit light of a first spectral distribution, $S_1$, in a first spatial direction, $D_1$. Furthermore, the LED filament(s) comprise(s) a second portion having a second shape, different from the first shape, wherein the second portion is configured to emit light of a second spectral distribution, $S_2$, in a second spatial direction, $D_2$. The first spectral distribution, $S_1$, is different from the second spectral distribution, $S_2$, and the first spatial direction, $D_1$, is different from the second spatial direction, $D_2$.

Thus, the present invention is based on the idea of providing a LED filament arrangement wherein (first) light with a first spectral distribution (e.g. a relatively high color temperature) from the first portion of the LED filament(s) may be directed in a desired and/or particular first direction, whereas (second) light with a second spectral distribution (e.g. a relatively low color temperature) from the second portion of the LED filament(s) may be directed in another desired and/or particular second direction, i.e. different from the first direction of the light from the first portion of the LED filament(s). For example, the light from the first portion may be directed towards an object such as a table, a painting, etc., whereas the light from the second portion may be directed in another direction or directions. Hence, the LED filament arrangement may provide different spectral and spatial distributions of the first and second portions of the LED filament, e.g. according to a particular need or preference. For example, the LED filament arrangement may be configured to provide a relatively cool white light from the first portion of the LED filament for illuminating an object such as a table.

The present invention is further advantageous in that the numerous advantages of using LED technology may be combined with the attractiveness and the appealing properties of the LED filament arrangement as disclosed.

The present invention is further advantageous in that the different shapes of the first and second portions of the LED filament(s) contribute to the aesthetic attractiveness of the LED filament arrangement.

The present invention is further advantageous in that the LED filament arrangement of the present invention comprises relatively few components. The low number of components is advantageous in that the LED filament arrangement is relatively inexpensive to fabricate. Moreover, the low number of components of the LED filament arrangement implies an easier recycling, especially compared to devices or arrangements comprising a relatively high number of components which impede an easy disassembling and/or recycling operation.

The LED filament lamp comprises at least one LED filament. The at least one LED filament, in its turn, comprises an array of LEDs. By the term "array", it is here meant a linear arrangement or chain of LEDs, or the like, arranged on the LED filament(s). The LEDs may furthermore be arranged, mounted and/or mechanically coupled on/to a carrier or substrate of each LED filament, wherein the carrier or substrate is configured to support the LEDs. The LED filament further comprises a first portion of a first shape, i.e. along the length of the first portion. By the term "shape", it is here meant the physical property of the portion such as e.g. the size, form and/or configuration of the portion. The first portion is configured to emit light of a first spectral distribution. By the term "spectral distribution", it is here meant a distribution of the light with respect to the frequency or wavelength of the light, such as the color (temperature) of the light. The first portion of the LED filament is further configured to emit light in a first spatial direction or distribution. Hence, upon operation of the LED filament arrangement, the first portion of the LED filament is configured to direct the light emitted therefrom in a (first) direction in space. The LED filament further comprises a second portion of a second shape, i.e. along the length of the second portion, which is different from the shape of the first portion. The second portion is configured to emit light of a second spectral distribution in a second spatial direction or distribution, wherein the first spectral distribution is different from the second spectral distribution, and the first spatial direction is different from the second spatial direction. Hence, upon operation of the LED filament arrangement, the first and second portions of each LED filament are configured to distribute light with a respective first and second spectral distribution, such as the color (temperature) of the light, wherein the first and second spectral distributions differ from each other. For example, the light emitted from the first portion during operation of the LED filament may have a relatively high color temperature, whereas the light emitted from the second portion during operation of the LED filament may have a relatively low color temperature. Furthermore, the first and second portions of the LED filament are configured to direct the light emitted therefrom in a respective first and second direction or distribution in space, such that the (first) light from the first portion and the (second) light from the second portion do not overlap, or only partially overlap.

According to an embodiment of the present invention, the first portion of the LED filament arrangement may be configured to emit light with a first color temperature, $CT_1$, and the second portion of the LED filament arrangement may be configured to emit light with a second color temperature, $CT_2$, wherein $CT_1 \neq CT_2$. Hence, the light emitted from the first portion during operation of the LED filament may have a color temperature which differs from the color temperature of the light emitted from the second portion.

According to an embodiment of the present invention, $CT_1 > CT_2$. Hence, the first color temperature, $CT_1$, of the light emitted from the first portion of the LED filament may be higher than the second color temperature, $CT_2$, of the light emitted from the second portion of the LED filament. For example, the light emitted from the first portion during operation of the LED filament may have a relatively high color temperature, whereas the light emitted from the second portion during operation of the LED filament may have a relatively low color temperature.

According to an embodiment of the present invention, the first portion may have a flat or disc shape. The present embodiment is advantageous in that the design or structure of the first portion improves directing the light in the first spatial direction.

According to an embodiment of the present invention, the first portion may have a twisted, bended or folded shape with respect to the second portion. The present embodiment is advantageous in that the design or structure of the first portion improves directing the light in the first spatial direction. Furthermore, the aesthetical appearance of the LED filament arrangement is increased.

According to an embodiment of the present invention, the second portion may have a spiral, meander, coil or helix shape. The present embodiment is advantageous in that the design or structure of the second portion improves directing the light in the second spatial direction. Furthermore, the aesthetical appearance of the LED filament arrangement is increased.

According to an embodiment of the present invention, the first and second color temperatures fulfill $300\ K < |CT_1 - CT_2| < 1000\ K$. It should be noted that many LED filament lamps are configured to emit a relatively low color temperature, which may be about 2200 K. For example, in a space such as living room, or the like, it may be preferred to have a color temperature of 2700 or 3000 K. Hence, it is desirable to be able to switch the color temperature between 2200 K and 2700 K/3000 K. Therefore, the present embodiment is advantageous in that the difference between $CT_1$ and $CT_2$ is at least 300 K, in order to achieve a (visible) effect. Furthermore, the present embodiment is advantageous in that the difference between $CT_1$ and $CT_2$ is less than 1000 K, thereby avoiding a too "cold" light and/or avoiding that the contrast between $CT_1$ and $CT_2$ is too high.

According to an embodiment of the present invention, the first portion may be configured to emit light with a first UV content, and wherein the second portion is configured to emit light with a second UV content, different from the first UV content. It will be appreciated that an alternative to the term "UV content" may be "UV component", or the like.

According to an embodiment of the present invention, the first portion may have a first length, $L_1$, and the second portion may have a second length, $L_2$, wherein $2L_1 < L_2$. It is preferred that $3\ L_1 < L_2 < 12\ L_1$, and even more preferred that $4\ L_1 < L_2 < 10\ L_1$. Hence, the first portion is much shorter than the second portion. The present embodiment is advantageous in that the relatively short first portion to an even higher extent may be designed to direct light in a specific spatial direction towards an object such as a table, a painting, etc., whereas the light from the relatively long second portion may be directed in another direction or other directions.

According to an embodiment of the present invention, the first portion may comprise M LEDs and the second portion may comprise N LEDs, wherein $2M < N$. It is preferred that $3\ M < N$, and even more preferred that $4\ M < N$. The present embodiment is advantageous in that the first portion, having a relatively small number of LEDs, to an even higher extent may be designed to direct light in a specific spatial direction towards an object such as a table, a painting, etc., whereas the light from the second portion, having a relatively large number of LEDs, may be directed in another direction or other directions.

According to an embodiment of the present invention, the at least one LED filament may comprise an encapsulant at least partially enclosing the plurality of LEDs, wherein the encapsulant comprises a luminescent material. By the term "encapsulant", it is here meant a material, element, arrangement, or the like, which is configured or arranged to at least partially surround, encapsulate and/or enclose the plurality of LEDs of the LED filament(s). By the term "luminescent material", it is here meant a material, composition and/or substance which is configured to emit light under external energy excitation. For example, the luminescent material may comprise a fluorescent material. The luminescent material is configured to convert at least a portion or part of the light emitted from the plurality of LEDs into converted light.

According to an embodiment of the present invention, the encapsulant may at least partially enclose at least one of the first portion and the second portion. Furthermore, at least one of a thickness, $T_L$, of the encapsulant and a concentration, $C_L$, of the luminescent material in the encapsulant may vary over the length of at least one of the first portion and the second portion. The present embodiment is advantageous in that the aesthetical appearance of the light emitted from the LED filament arrangement is even further enhanced.

According to an embodiment of the present invention, the at least one LED filament may comprise a carrier (e.g. a substrate) arranged to support the plurality of LEDs, wherein the carrier is light transmissive. The present embodiment is advantageous in that at least a portion of the light from the LEDs of the LED filament(s) may be transmitted through the carrier, thereby further contributing to the lighting properties and/or decorative appearance of the LED filament arrangement.

According to an embodiment of the present invention, the carrier may comprise a first side and a second side, opposite the first side, wherein the plurality of LEDs is arranged on the first side of the carrier. The at least one LED filament further comprises an encapsulant at least partially enclosing at least one of the first side and the second side of the carrier, wherein the encapsulant comprises a luminescent material.

According to an embodiment of the present invention, there is provided a lighting device. The lighting device may comprise a LED filament arrangement according to any one of the preceding embodiments, and a cover comprising an at least partially light-transmissive material, wherein the cover at least partially encloses the LED filament arrangement. The lighting device may further comprise an electrical connection connected to the LED filament arrangement for a supply of power to the plurality of LEDs of the LED filament arrangement.

According to an embodiment of the present invention, there is provided a luminaire. The luminaire may comprise a lighting device according to the previous embodiment and at least one reflector, wherein the lighting device is arranged at least partially within the at least one reflector.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
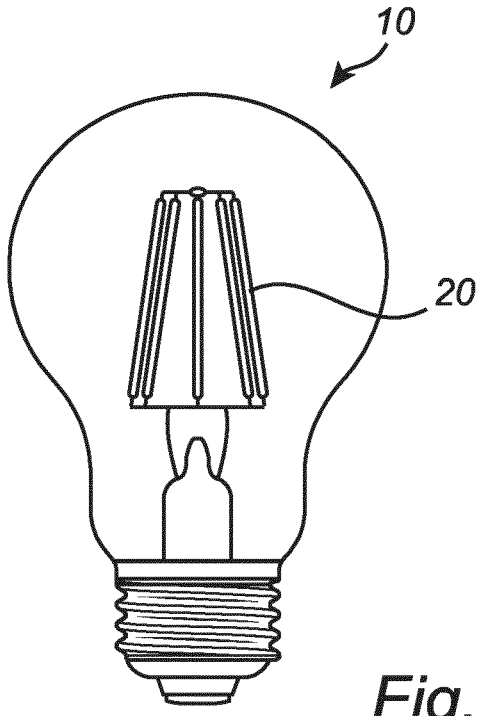
FIG. 1 shows a LED filament lamp according to the prior art.

FIG. 1 shows a LED filament lamp 10 according to the prior art, comprising a plurality of LED filaments 20. LED filament lamps 10 of this kind are highly appreciated as they are very decorative, as well as providing numerous advantages compared to incandescent lamps such as a longer operational life, a reduced power consumption, and an increased efficiency related to the ratio between light energy and heat energy. LED filament lamps 10 of this kind are able to produce warm white light. However, it is of interest to improve the properties of the light emitted from the LED filaments 20 without impairing the appearance and/or the decorative aspect of the LED filaments 20 and/or the LED filament lamps 10.

Figure 2:
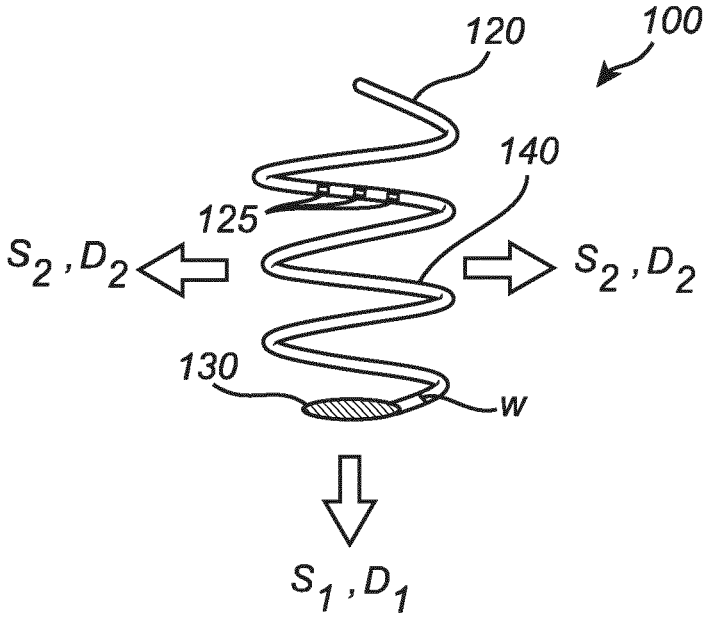
FIG. 2 shows a LED filament arrangement according to an exemplifying embodiment of the present invention.

FIG. 2 shows a LED filament arrangement 100 according to an exemplifying embodiment of the present invention. The LED filament arrangement 100 comprises a LED filament 120 (which furthermore may comprise multiple sub-filaments). The LED filament 120 is providing LED filament light and comprises a plurality of LEDs 125 arranged in an array. The plurality of LEDs 125 preferably comprises more than 5 LEDs, more preferably more than 8 LEDs, and even more preferred more than 10 LEDs. The plurality of LEDs 125 may be direct emitting LEDs which provide a color. Preferably, the LED filament 120 has a length L (not shown) and a width W, wherein L>5W. Preferably, the LEDs 125 are arranged on an elongated carrier like for instance a substrate, that may be rigid (made from e.g. a polymer, glass, quartz, metal or sapphire) or flexible (e.g. made of a polymer or metal, e.g. a film or (polyimide) foil). In case the carrier comprises a first major surface and an opposite second major surface, the plurality of LEDs 125 is arranged on at least one of these surfaces. The carrier may be reflective or light transmissive, such as translucent and preferably transparent. The LED filament 120 may further comprise an encapsulant 145 at least partly covering at least part of the plurality of LEDs 125. For example, the encapsulant 145 may (continuously) cover the LEDs 125 of a first portion of the LED filament 120 and/or (continuously) cover the LEDs 125 of a second portion of the LED filament 120. The encapsulant 145 may be a polymer material which may be flexible such as for example a silicone. Further, the plurality of LEDs 125 may be arranged for emitting LED light e.g. of different colors or spectrums. The encapsulant 145 may comprise a luminescent material that is configured to at least partly convert LED light into converted light. The luminescent material may be a light-scattering material, e.g. a polymer matrix comprising BaSO4, Al2O3 and/or TiO2 particles. The luminescent material may be a phosphor such as an inorganic phosphor (e.g. YAG, LuAG, ECAS, KSiF, etc.) and/or quantum dots or rods. The phosphor may further be e.g. a (blue) green/yellow and/or red phosphor. The luminescent material may hereby be configured to convert e.g. UV LED light into blue converted light and/or UV/blue LED into green/yellow and/or red converted light.

The LED filament 120 in FIG. 2 is arranged in a spiral or helix. The LED filament 120 comprises a first portion 130 and a second portion 140, wherein the first portion 130 is provided at a tip (end) portion of the second portion 140. The first portion 130 has a (first) length which is much smaller than a (second) length of the second portion 140.

Furthermore, the first portion 130 of the LED filament 120 may have M LEDs and the second portion may comprise N LEDs, wherein e.g. 2M<N. The first portion 130 may be flexible and the second portion 140 may be rigid, or the other way around, i.e. that the first portion 130 may be rigid and the second portion 140 may be flexible.

The first portion 130 is configured to emit light in a first spatial direction, $D_1$. Here, the first portion 130 is configured to emit light in a first spatial direction, $D_1$, which is shown downwards in the orientation of the LED filament 120 in FIG. 2. However, it will be appreciated that the first spatial direction, $D_1$, may be substantially any spatial direction from the first portion 130. Furthermore, the first portion 130 is configured to emit light of a first spectral distribution, $S_1$, e.g. a first (color) temperature. For example, the (first) light from the first portion 130 may have a relatively high color temperature, $CT_1$, and may be directed towards an object such as a table, a painting, etc. (not shown). Furthermore, the first portion 130 has a first shape, which is exemplified as a flat or disc shape.

The LED filament 120 further comprises a second portion 140 which is configured to emit light in a second spatial direction, $D_2$. Here, the second portion 140 is configured to emit light in a second spatial direction, $D_2$, which is indicated sideways with respect to the orientation of the LED filament 120 as shown in FIG. 2. However, it will be appreciated that the second spatial direction, $D_2$, may be substantially any desired spatial direction from the second portion 140, wherein the second spatial direction, $D_2$, is different from the first spatial direction, $D_1$. Furthermore, the second portion 140 is configured to emit light of a second spectral distribution, $S_2$, e.g. a second (color) temperature, which is different from the first spectral distribution, $S_1$. For example, the first spectral distribution, $S_1$, may have a first color point (x1, y1) and the second spectral distribution may have a second color point (x2, y2) different from the first color point. Preferably $|(x2-x1)|>0.3$ and/or $|(y2-y1)|>0.3$.

The (second) light from the second portion 140 may have a relatively low color temperature, such that $CT_2<CT_1$. Furthermore, the second portion 140 has a second shape, which is exemplified as a spiral or helix.

The (first) light from the first portion 130 and the (second) light from the second portion 140 may fulfill $CT_1>CT_2$ and $300\ K<|(CT_1-CT_2)|<1000\ K$. Furthermore, the first portion 130 may be configured to emit light with a first UV content, and the second portion may be configured to emit light with a second UV content, different from the first UV content.

Although not shown in FIG. 2, a thickness of the encapsulant 145 and/or a concentration of the luminescent material in the encapsulant 145 of the LED filament 120 may vary over the length of the first portion 130 and/or the second portion 140.

FIGS. 3*a*-3*f* show LED filaments 120 of a LED filament arrangement according to exemplifying embodiments of the present invention.

Figure 3A:
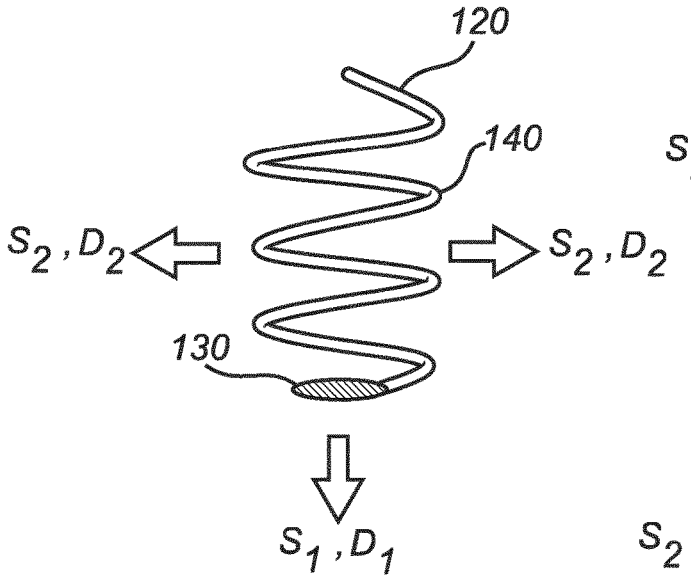
FIGS. 3*a*-3*g* show LED filaments of a LED filament arrangement according to exemplifying embodiments of the present invention.

FIG. 3*a* shows the shape of the first and second portions 130, 140 of the LED filament 120 as depicted in FIG. 2*a*, i.e. that the first portion 130 comprises a flat shape and is arranged at a tip (end) portion of the helix shaped second portion 140. The light from the first portion 130 is emitted in a first spatial direction, $D_1$, which is exemplified in a downwards direction, and with a first spectral distribution, $S_1$. The light from the second portion 140 is emitted in a second spatial direction, $D_2$, which is exemplified in a circumferential second direction, $D_2$, with respect to the spiral or helix-shaped second portion 140. The light from the second portion 140 has a second spectral distribution, $S_2$, different from the first spectral distribution, $S_1$.

Figure 3B:
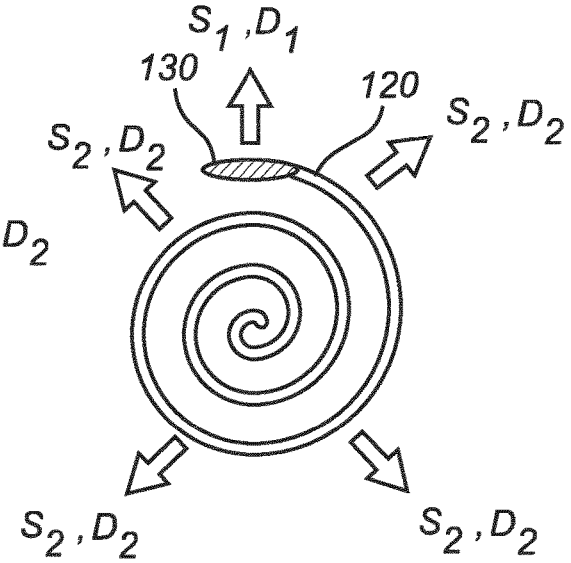

In FIG. 3*b*, the first portion 130 of the LED filament 120 comprises a flat shape and is arranged at a tip (end) portion of the second portion 140 of the LED filament 120 which has the shape of a spiral. The light from the first portion 130 is emitted in a first spatial direction, $D_1$, which is exemplified in an upwards direction, and with a first spectral distribution, $S_1$. The light from the second portion 140 is emitted in a second spatial direction, $D_2$, which is exemplified in a circumferential second direction, $D_2$, with respect to the helix-shaped second portion 140. The light from the second portion 140 has a second spectral distribution, $S_2$, different from the first spectral distribution, $S_1$.

Figure 3C:
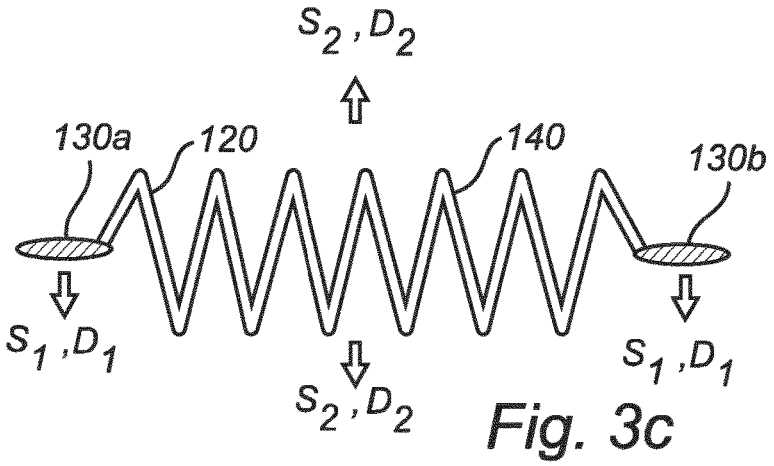

In FIG. 3*c*, the second portion 140 of the LED filament 120 comprises a wave or saw-tooth shape, wherein two first portions 130*a*, 130*b* of the LED filament 120 are arranged at the respective end (tip) portions of the second portion 140. The light from the first portions 130*a*, 130*b* is emitted in a respective first spatial direction, $D_1$, which is exemplified in the downward directions from the first portions 130*a*, 130*b*, and with a respective first spectral distribution, $S_1$. The light from the second portion 140 is emitted in a second spatial direction, $D_2$, which is exemplified in a circumferential second direction, $D_2$, with respect to the second portion 140. The light from the second portion 140 has a second spectral distribution, $S_2$, different from the first spectral distribution, $S_1$.

Figure 3D:
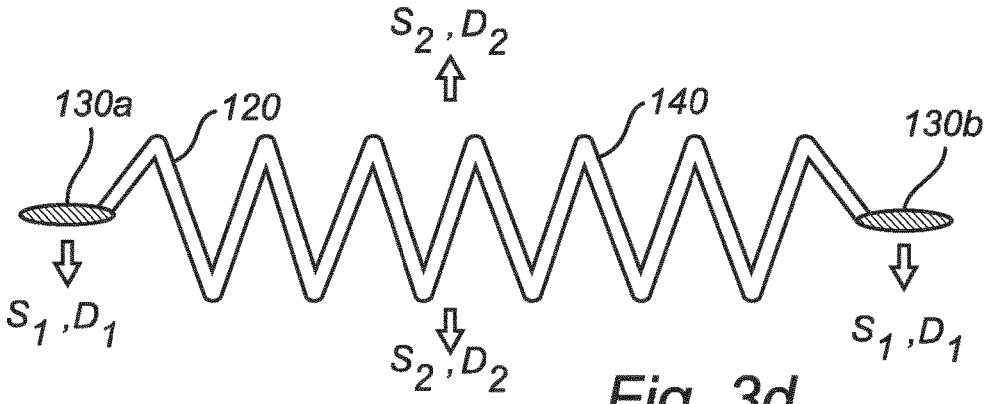

FIG. 3*d* shows a similar example of the LED filament 120 of FIG. 3*c*. Here, the 'periods' of the wave or saw-tooth shape is somewhat longer than in FIG. 3*c*. Furthermore, the light from the first portion 130 has a different first spectral distribution (e.g. color temperature, $CT_1$) compared to that in FIG. 3*c*.

Figure 3E:
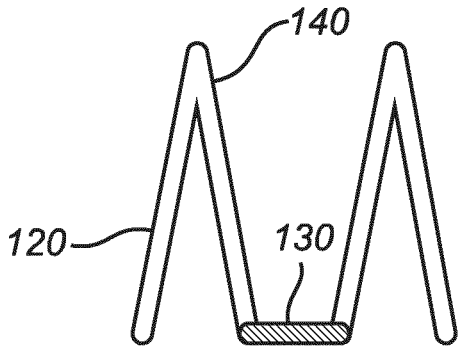

In FIG. 3*e*, the second portion 140 of the LED filament 120 comprises two 'peaks', wherein a first portion 130 of the LED filament 120 is arranged between the peaks of the second portion 130. In this example, the LED filament 120 has the shape of a crown. The (first) light from the first portion 130 and the (second) light from the second portion 140 are not indicated in FIG. 3*e*.

Figure 3F:
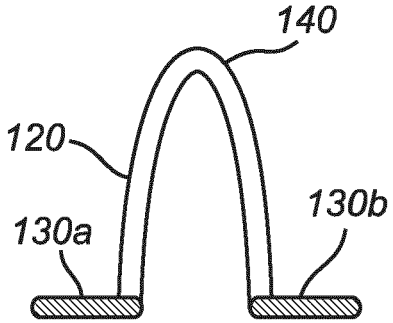

In FIG. 3*f*, the LED filament 120 comprises two first portions 130*a*, 130*b*, and a U-shaped or arch-shaped second portion 140 arranged between the first portions 130*a*, 130*b*. The (first) light from the first portions 130*a*, 130*b* and the (second) light from the second portion 140 are not indicated in FIG. 3*f*.

Figure 3G:
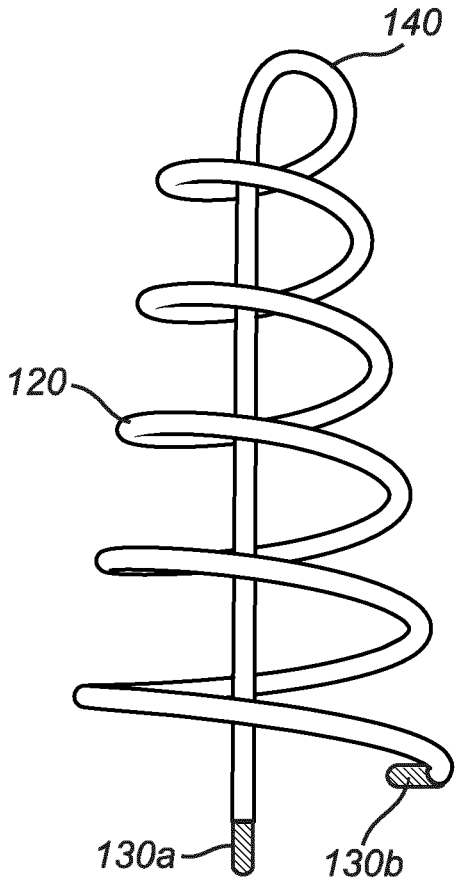

In FIG. 3*g*, the second portion 140 of the LED filament 120 comprises a cylinder or cone-shaped spiral or helix between the two first portions 130*a*, 130*b*. The (first) light from the first portions 130*a*, 130*b* and the (second) light from the second portion 140 are not indicated in FIG. 3*g*.

Figure 4B:
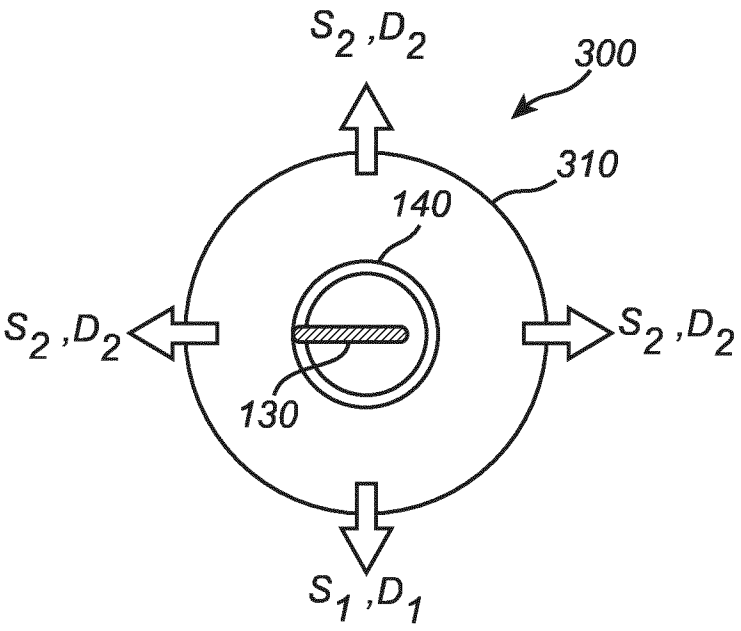
FIGS. 4-6 show LED lighting devices comprising LED filament arrangements according to exemplifying embodiments of the present invention.
Figure 4A:
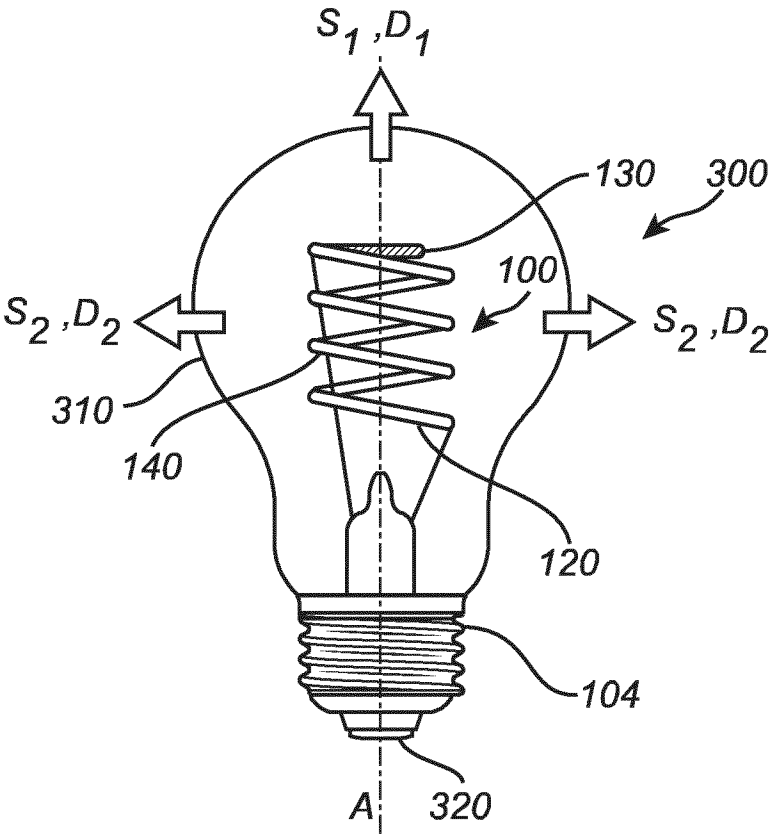

FIGS. 4*a* and 4*b* show a side view and a top view, respectively, of a LED lighting device 300 comprising a LED filament arrangement 100 according to an exemplifying embodiment of the present invention. The lighting device 300 comprises an envelope or cover 310 of light-transmissive material, which preferably is made of glass. The cover 310 encloses the LED filament arrangement 100. The LED lighting device 300 further comprises a threaded cap 104 which is connected to the cover 310. The LED lighting device 300 further comprises an electrical connection 320 connected to the LED filament arrangement 100 for a supply of power to the plurality of LEDs of the LED filament arrangement 100.

In FIG. 4*a*, the first portion 130 of the LED filament 120 comprises a flat shape and is arranged at a tip (end) portion of the second portion 140 of the LED filament 120, wherein the second portion 140 has the shape of a helix. The LED filament 120 elongates along the longitudinal axis, A, of the LED lighting device 300. Consequently, the light from the first portion 130 is emitted in a first spatial direction, $D_1$, which is exemplified in a upwards direction. The light from the second portion 140 is emitted in a second spatial direction, $D_2$, which is exemplified in a circumferential second direction, $D_2$, with respect to the helix-shaped second portion 140. Hence, the first spatial direction, $D_1$, of the light from the first portion 130 of the LED filament 120 is different from the second spatial direction, $D_2$, of the light from the second portion 140 of the LED filament 120.

FIG. 4*b* shows a top view of the LED lighting device 300 in FIG. 4*a*, and it is also referred to FIG. 4*a* for an increased understanding. FIG. 4*b* schematically indicates some of the elements and associated references provided in FIG. 4*a*, and indicates the emission of the light from the second portion 140 in the second spatial direction, $D_2$.

Figure 5C:
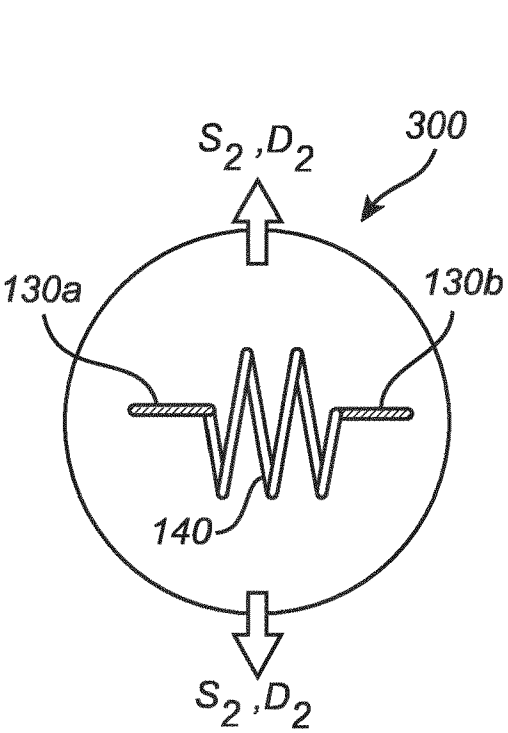
Figure 5B:
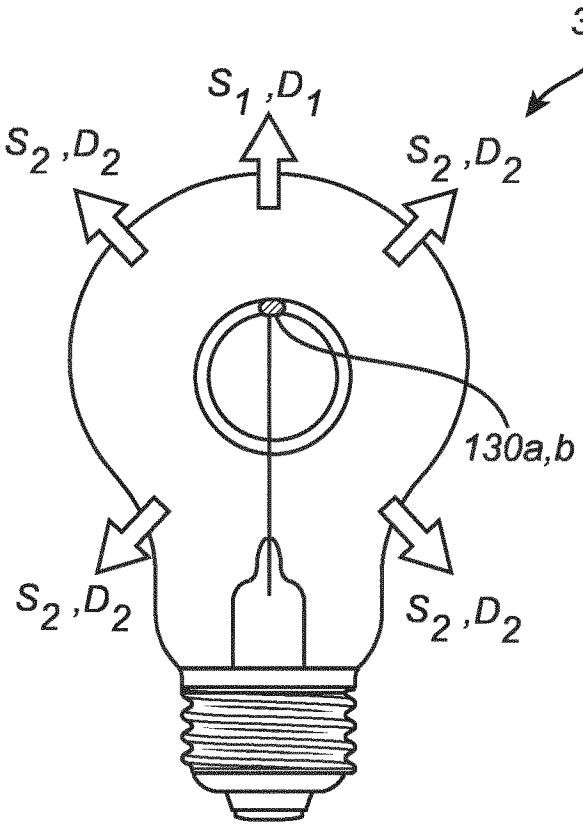
Figure 5A:
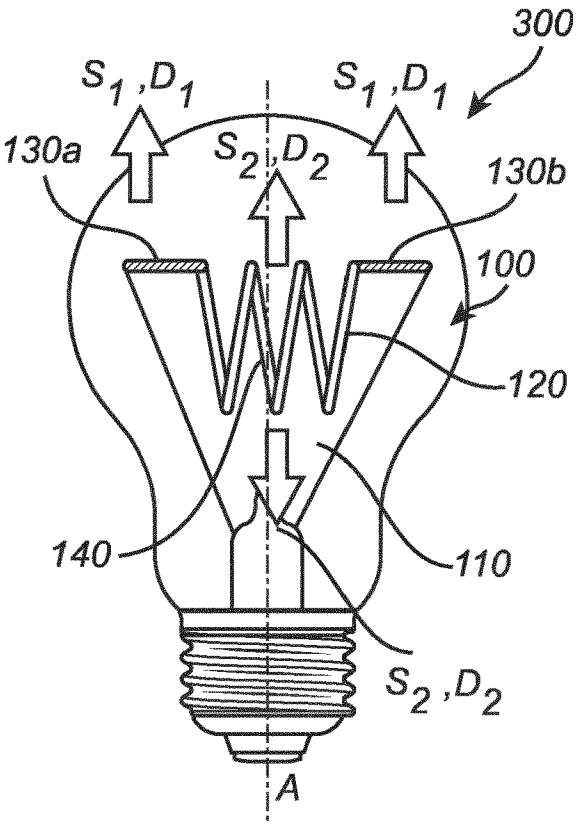

FIGS. 5*a*, 5*b* and 5*c* show a first side view, a second side view and a top view, respectively, of a LED lighting device 300 comprising a LED filament arrangement 100 according to an exemplifying embodiment of the present invention. Similar to FIG. 4*a*, the first portions 130*a*, 130*b* of the LED filament 120 in FIG. 5*a* each comprises a flat shape and is arranged at respective tip (end) portions of the second portion 140 of the LED filament 120, wherein the second portion 140 has the shape of a helix. In contrast to the LED filament 120 of FIG. 4*a*, the LED filament 120 in FIG. 5*a* elongates perpendicular to the longitudinal axis, A, of the LED lighting device 300. Consequently, the light from the first portions 130*a*, 130*b* is emitted in a respective first spatial direction, $D_1$, which is exemplified in an upward direction. The light from the second portion 140 is emitted in a second spatial direction, $D_2$, which is exemplified in a circumferential second direction, $D_2$.

FIG. 5*b* shows a second side view of the LED lighting device 300 of FIG. 5*a*, wherein the second side view of FIG. 5*b* is shown in an angle of 90° with respect to the first side view of FIG. 5*a*. In FIG. 5*b*, the light from the first portions 130*a*, 130*b* is emitted in a first spatial direction, $D_1$, which is exemplified in an upward direction, and the light from the second portion 140 is emitted in a second spatial direction, $D_2$, which is exemplified in a circumferential second direction, $D_2$.

FIG. 5*c* shows a top view of the LED lighting devices in FIGS. 5*a* and 5*b*, and it is also referred to FIGS. 5*a* and 5*b* for an increased understanding. FIG. 5*c* schematically indicates the emission of the light from the second portion 140 in the second spatial direction, $D_2$.

Figure 6C:
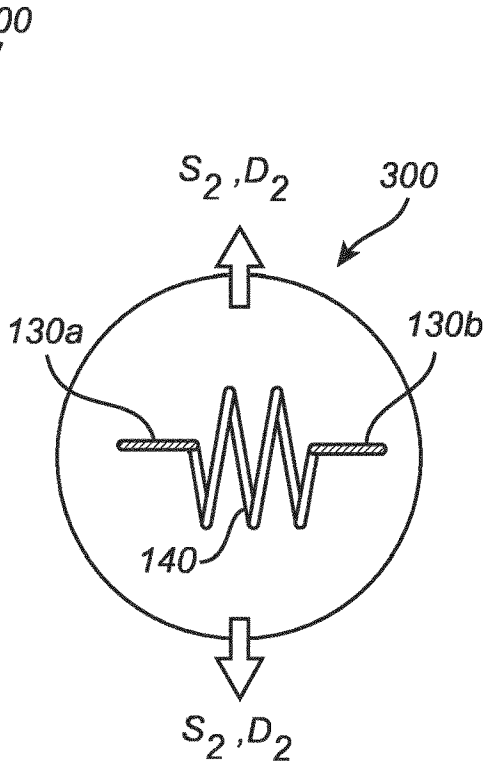
Figure 6B:
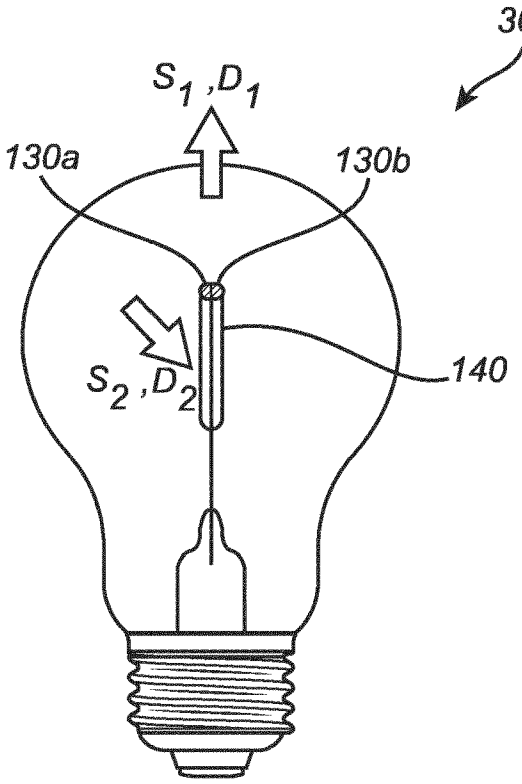
Figure 6A:
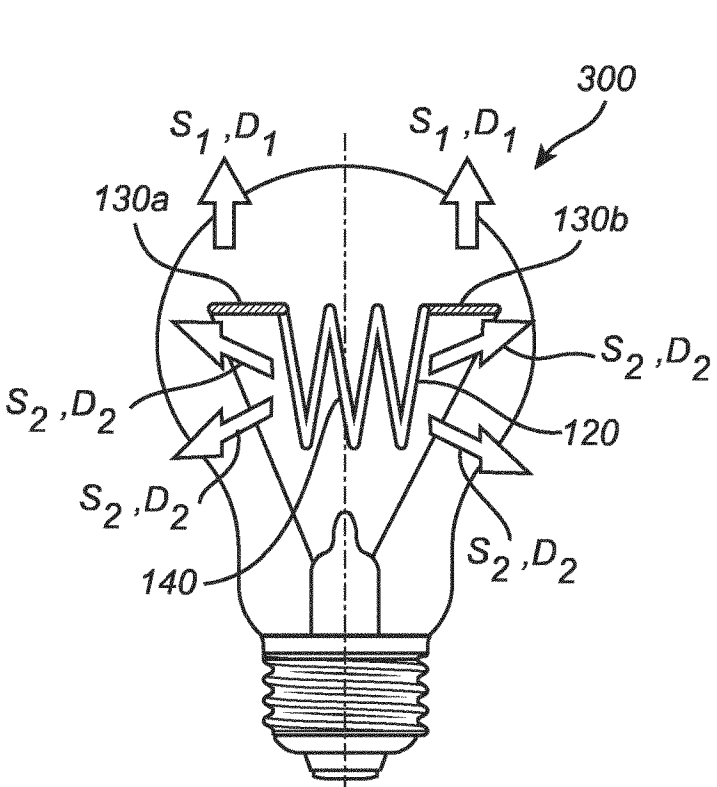

FIGS. 6*a*, 6*b* and 6*c* show a first side view, a second side view and a top view, respectively, of a LED lighting device 300 comprising a LED filament arrangement 100 according to an exemplifying embodiment of the present invention. In FIG. 6*a*, the second portion 140 of the LED filament 120 comprises a meander, wave or saw-tooth shape, wherein two first portions 130*a*, 130*b* of the LED filament 120 are arranged at the respective end (tip) portions of the second portion 140. The LED filament 120 in FIG. 6*a* elongates perpendicular to the longitudinal axis, A, of the LED lighting device 300. Consequently, the light from the first portions 130*a*, 130*b* is emitted in a respective first spatial direction, $D_1$, which is exemplified in an upward direction. The light from the second portion 140 is emitted in a second spatial direction, $D_2$, which is exemplified in a second direction, $D_2$, as indicated by the arrows.

FIG. 6*b* shows a second side view of the LED lighting device 300 of FIG. 6*a*, wherein the second side view of FIG. 6*b* is shown in an angle of 90° with respect to the first side view of FIG. 6*a*. The light from the first portions 130*a*, 130*b* is emitted in a first spatial direction, $D_1$, which is exemplified in an upward direction, and the light from the second portion 140 is emitted in a second spatial direction, $D_2$, which is exemplified in a second direction, $D_2$, which constitutes a plane along the longitudinal axis of the LED lighting device 300.

FIG. 6*c*, showing a top view of the LED lighting device 300 in FIGS. 6*a* and 6*b*, and it is also referred to FIGS. 6*a* and 6*b* for an increased understanding. FIG. 6*c* schematically indicates the emission of the light from the second portion 140 in the second spatial direction, $D_2$.

It should be noted that for all exemplifying embodiments of FIGS. 6*a*, 6*b* and 6*c*, the first portion(s) 130 of the LED filament 120 may be arranged at least partly in the second portion 140 of the LED filament 120. Alternatively, the first portion(s) 130 may be arranged outside the second portion 140.

The person skilled in the art realizes that the present invention by no means is limited to the preferred embodiments described above. On the contrary, many modifications and variations are possible within the scope of the appended claims. For example, one or more of the LED filament(s) 120, the first portion 130 and/or the second portion 140 of the LED filament 120, etc., may have different shapes, dimensions and/or sizes than those depicted/described.

The invention claimed is:

1. A light emitting diode, LED, filament arrangement, comprising at least one LED filament comprising an array of a plurality of light emitting diodes, LEDs, wherein the at least one LED filament comprises a first portion having a first shape, wherein the first portion is configured to emit light of a first spectral distribution, $S_1$, in a first spatial direction, $D_1$, and a second portion having a second shape, different from the first shape, wherein the second portion is configured to emit light of a second spectral distribution, $S_2$, in a second spatial direction, $D_2$, wherein first spectral distribution, $S_1$, is different from the second spectral distribution, $S_2$, and wherein the first spatial direction, $D_1$, is different from the second spatial direction, $D_2$, and, wherein the second portion has a spiral, meander, coil or helix shape.

2. The LED filament arrangement according to claim 1, wherein the first portion is configured to emit light with a first color temperature, $CT_1$, and wherein the second portion is configured to emit light with a second color temperature, $CT_2$, wherein $CT_1 \neq CT_2$.

3. The LED filament arrangement according to claim 2, wherein $CT_1 > CT_2$.

4. The LED filament arrangement according to claim 2, wherein the first and second color temperatures fulfill $300\ K < |(CT_1 - CT_2)| < 1000\ K$.

5. The LED filament arrangement according to claim 1, wherein the first portion has a flat or disc shape.

6. The LED filament arrangement according to claim 1, wherein the first portion has a twisted, bended or folded shape with respect to the second portion.

7. The LED filament arrangement according to claim 1, wherein the first portion is configured to emit light with a first UV content, and wherein the second portion is configured to emit light with a second UV content, different from the first UV content.

8. The LED filament arrangement according to claim 1, wherein the first portion has a first length, $L_1$, and the second portion has a second length, $L_2$, wherein $2L_1 < L_2$.

9. The LED filament arrangement according to claim 1, wherein the first portion comprises M LEDs and the second portion comprises N LEDs, wherein $2M < N$.

10. The LED filament arrangement according to claim 1, wherein the at least one LED filament comprises an encapsulant at least partially enclosing the plurality of LEDs, wherein the encapsulant comprises a luminescent material.

11. The LED filament arrangement according to claim 10, wherein the encapsulant at least partially encloses at least one of the first portion and the second portion, and wherein at least one of a thickness, $T_L$, of the encapsulant and a concentration, $C_L$, of the luminescent material in the encapsulant varies over the length of at least one of the first portion and the second portion.

12. The LED filament arrangement according to claim 1, wherein the at least one LED filament comprises a carrier arranged to support the plurality of LEDs, wherein the carrier is light transmissive.

13. The LED filament arrangement according claim 1, wherein the carrier comprises a first side and a second side, opposite the first side, wherein the plurality of LEDs is arranged on the first side of the carrier, and wherein the at least one LED filament comprises an encapsulant at least partially enclosing at least one of the first side and second side of the carrier, wherein the encapsulant comprises a luminescent material.

14. A lighting device, comprising a LED filament arrangement according to claim 1, a cover comprising an at least partially light-transmissive material, wherein the cover at least partially encloses the LED filament arrangement, and an electrical connection connected to the LED filament arrangement for a supply of power to the plurality of LEDs of the LED filament arrangement.

* * * * *